US008109001B2

(12) United States Patent
Royle et al.

(10) Patent No.: US 8,109,001 B2
(45) Date of Patent: Feb. 7, 2012

(54) SHAVING SYSTEM FOR PERFORMING MULTIPLE SHAVING ACTIONS

(75) Inventors: Terence G. Royle, Basingstoke (GB); Robert White, Yelverton (GB)

(73) Assignee: The Gillette Company, Boston, MA (US)

( * ) Notice: Subject to any disclaimer, the term of this patent is extended or adjusted under 35 U.S.C. 154(b) by 33 days.

(21) Appl. No.: 12/150,279

(22) Filed: Apr. 25, 2008

(65) Prior Publication Data

US 2008/0216320 A1 Sep. 11, 2008

Related U.S. Application Data

(60) Continuation of application No. 11/784,897, filed on Apr. 10, 2007, which is a division of application No. 11/101,325, filed on Apr. 7, 2005, now abandoned, which is a continuation of application No. PCT/US03/31676, filed on Oct. 6, 2003.

(30) Foreign Application Priority Data

Oct. 8, 2002 (EP) ..... 02022316

(51) Int. Cl.

| | |
|---|---|
| ***B26B 19/04*** | (2006.01) |
| ***B26B 19/26*** | (2006.01) |
| *B26B 19/06* | (2006.01) |
| *B26B 21/06* | (2006.01) |

(52) U.S. Cl. ..... 30/34.1; 30/34.05; 30/42; 30/43.92; 30/77; 30/78; 30/83

(58) Field of Classification Search ..... 30/34.05, 30/34.1, 42, 43, 43.7, 43.8, 43.9, 43.91, 43.92, 30/77, 78, 80, 83, 346.51

See application file for complete search history.

(56) References Cited

U.S. PATENT DOCUMENTS

| | | | |
|---|---|---|---|
| 2,870,534 | A | 1/1959 | Angst et al. |
| 3,456,341 | A | 7/1969 | Loner et al. |
| 3,589,005 | A | 6/1971 | Fischer et al. |
| 3,702,026 | A | 11/1972 | Scholin |
| 3,855,697 | A | 12/1974 | Meyer et al. |
| 3,879,845 | A | 4/1975 | Hansom et al. |
| 3,950,847 | A | 4/1976 | Duda |
| 3,967,372 | A | 7/1976 | Beck et al. |
| 4,310,968 | A | 1/1982 | Buik et al. |

(Continued)

FOREIGN PATENT DOCUMENTS

| | | |
|---|---|---|
| CH | 191603 | 9/1937 |

(Continued)

OTHER PUBLICATIONS

Search Report from corresponding CN application 2003801010.

*Primary Examiner* — Clark F. Dexter
(74) *Attorney, Agent, or Firm* — Jay A. Krebs

(57) ABSTRACT

Shaving apparatus including a drivable shaving unit for performing a first shaving action on a user's skin; a motor adapted to drive the shaving unit to perform the first shaving action; a blade having a razor-sharp cutting edge positioned for shaving engagement with the user's skin; and a guard surface provided in front of the razor-sharp blade. During use, the blade performs a second shaving action to cut hair while the drivable shaving unit performs the first shaving action. The first shaving unit may be rotary or linear and may have a static or moving skin-engaging cutter. Two razor-sharp blades may be provided, facing in opposite directions.

4 Claims, 15 Drawing Sheets

U.S. PATENT DOCUMENTS

| | | | |
|---|---|---|---|
| 4,483,068 | A | 11/1984 | Clifford |
| 4,649,642 | A | 3/1987 | Nagasaki et al. |
| 4,807,360 | A | 2/1989 | Cerier et al. |
| 4,922,608 | A | 5/1990 | Pahl |
| 5,022,154 | A | 6/1991 | Johnson |
| 5,153,992 | A | 10/1992 | Brown et al. |
| 5,305,506 | A | 4/1994 | Forman |
| 5,490,329 | A | 2/1996 | Chylinski et al. |
| 5,522,137 | A | 6/1996 | Andrews |
| 5,551,153 | A | 9/1996 | Simms |
| 5,604,983 | A | 2/1997 | Simms et al. |
| 5,661,907 | A | 9/1997 | Apprille, Jr. |
| 5,669,138 | A | 9/1997 | Wetzel |
| 5,745,995 | A | 5/1998 | Yamashita et al. |
| 5,946,806 | A | 9/1999 | Watanabe et al. |
| 6,098,289 | A | 8/2000 | Wetzel et al. |
| 6,138,361 | A | 10/2000 | Richard et al. |
| 6,223,438 | B1 | 5/2001 | Parsonage et al. |
| 6,293,017 | B1 | 9/2001 | Sato et al. |
| 2001/0027608 | A1 | 10/2001 | Barish |
| 2001/0042308 | A1 | 11/2001 | Barish |

FOREIGN PATENT DOCUMENTS

| | | |
|---|---|---|
| CH | 199850 | 6/1939 |
| CN | 1230479 | 6/1999 |
| DE | 1 182 554 | 11/1964 |
| DE | 25 03 175 | 7/1975 |
| DE | 34 28 631 | 2/1986 |
| DE | 3531408 | 5/1987 |
| EP | 0477132 | 3/1992 |
| GB | 624 077 | 5/1949 |
| GB | 1 444 960 | 8/1976 |
| GB | 1 460 732 | 1/1977 |
| GB | 1 469 556 | 4/1977 |
| GB | 1 533 679 | 11/1978 |
| JP | 9253355 | 9/1997 |
| JP | 2000-288267 | 10/2000 |
| WO | WO 96/30176 | 10/1996 |
| WO | WO 98/07551 | 2/1998 |
| WO | WO 98/35795 | 8/1998 |
| WO | WO 00/13859 | 3/2000 |
| WO | WO 01/07212 | 2/2001 |
| WO | WO 01/07213 | 2/2001 |

SHAVING SYSTEM FOR PERFORMING MULTIPLE SHAVING ACTIONS

CROSS REFERENCE TO RELATED APPLICATION

This is a continuation of U.S. application Ser. No. 11/784,897, filed Apr. 10, 2007, which is a divisional of U.S. application Ser. No. 11/101,325, filed Apr. 7, 2005, now abandoned, which is a continuation of PCT Application No. PCT/US2003/031676, filed on Oct. 6, 2003, which claims priority to Europe Patent Application No. 02022316.0, filed on Oct. 8, 2002, which is incorporated herein by reference in its entirety.

BACKGROUND

The present invention relates to a shaving system in which more than one shaving action is performed during a shaving operation, to methods of shaving, and to blade unit subassemblies and cassettes for use in such apparatus and methods.

A shaving system having one stationary razor blade and one linearly reciprocating razor blade is known from Swiss patent CH199 850 (Metzler et al.). This arrangement has two double-edged sided razor blades (38, 39) of the "Gillette type" (see page 3, left column, line 21) and reciprocates one razor blade (39) while the other razor blade (38) of the two is stationary. The moving razor blade is actuated by pins 31 on a linearly reciprocating pusher 30, the pins 31 engaging in the short slots 40 of the moving blade 39, whereas the stationary blade 38 has longer clearance slots 41 so that the pins 31 move without moving the stationary blade 38 (page 3, left column, lines 4 to 18). The razor blades are positioned so that either the top razor blade moves and the bottom blade is stationary, or the bottom razor blade moves and the top blade is stationary (page 3, right column, lines 3 to 9). Guard (24, 25) is positioned in front of the forward blade.

Systems are known in which a rotating guard member is positioned in front of a sharp safety razor, e.g. U.S. Pat. No. 5,022,154 (Johnson). A shaving system having a plurality of pairs of rotating sieve-like guard elements positioned in front of and feeding hairs to razor blades positioned behind the rotating guards is known from German patent DE 1 182 554 (Brand). The roller-guard and razor blade pairs are positioned around the semi-circular periphery of the shaver housing (FIG. 2). The cylindrical roller guard 1 is rotated by having its friction roller end 13 driven by a friction driver wheel 4. Each razor blade 2 is mounted on a bridge 3, and are either static or driven in linear reciprocation shown by arrow 24 in FIG. 6, see column 3, lines 49 to 52. When the razor blades are linearly oscillated as in FIG. 6, they are driven by contours 19 in cam wheel 20 against restoring springs 2a (FIG. 3), and the blade edge can have serrations 22. As described at column 4, lines 27 to 39, and FIG. 6, the roller guards have rectangular openings 26 formed by the framework of the roller guard, and in operation beard hair enters the openings 26 and by rotation of roller guard 1 is pushed against the razor blade 2 for cutting.

A shaving system having both a static guard and a rotating, profiled feeder positioned in front of a sharp razor blade is known from German patent application DE 25 03 175 (Hansom). This document shows two types of embodiments, the first that of FIGS. 1-5, and the second that of FIGS. 6-8. In each, the static guard 5 or 36 is positioned in front of a single wet safety-razor type blade edge 4 or 33, which defines with the sharp edge a skin plane 7 or 44, and a beard hair is shown as 13 or 45 (FIG. 1, 8). Between the static guard and the blade edge is a rotating feeder. The rotating feeder of FIG. 1 is a cylindrical sleeve 8 defining three longitudinal slits which define continuous edges 11. In operation described at page 5, rotation of the edges 11 effects that hairs 13 are brought into contact with sharp cutting edge 4 to be cut. Alternative versions of the rotating feeder are described at pages 5 to 6 that it is a rotating strip having two edges, and that the strip can be straight or spiral; or can be cross-shaped (FIG. 3); or toothed (FIG. 4); or a perforated sleeve 20 with openings 22 (FIG. 5), and the embodiments of FIGS. 1 to 5 do not disclose that the edges of the rotating feeder are sharp. In the alternative embodiment of FIG. 6 the rotating feeder is formed by a conventional drill bit shaft 23 having two spiral edges 25 which are sharp (page 7, lines 1-5), and shown in cross-section in FIG. 8. The DE 25 03 175 states that since the skin is flexible the drill bit shaft 23 is spaced from skin plane 44 so as to not contact the skin since otherwise the user will experience an undesirable burning irritation feeling.

Shaving systems comprising multiple foil-type units are known, e.g. from U.S. Pat. No. 6,098,289 (Wetzel et al.) which also discloses combinations of short hair cutters with a long hair cutter, or also U.S. Pat. No. 6,223,438 (Parsonage et al.) or U.S. Pat. No. 3,967,372 (Beck et al.).

Shaving systems comprising multiple razor-sharp blades are also known, e.g. from GB-A-1,460,732 which describes shaving cartridges comprising two parallel razor-sharp blades, and U.S. Pat. No. 5,661,907 (Apprille, Jr.) which discloses a shaving cartridge comprising three parallel razor-sharp blades.

It is also known to provide a long hair trimming unit comprising a pair of interacting blades at the upper side of the shaver alongside a foil-type reciprocating shaving unit, e.g. JP-A-2000-288267 (Hitachi Maxell).

It is further known to have non-cutting, hair-erecting scraper edges positioned adjacent or radially outward of the rotary cutter units on known rotary-type electric shavers such as sold by Philips Corporation. See WO 00/13859 (Barish), which discloses a rib-like, thin, blunt scraper member (232) surrounding each cutter (FIG. 20) and a common scraper member (242) (see FIG. 22) surrounding the several cutters. Allegedly, the scraper member tautens the skin and erects the hairs, but does not cut the hair, just before hairs are received within the slits of the electric razor cutter, for producing a closer shave when the electric shaver is used with a lubricating liquid for effecting a wet shave, as described at pages 13-15 therein. However, if such a construction is used without a lather when operated in a dry shaver mode, it will disadvantageously increase skin irritation. It is also known from United States published patent applications US 2001/0027608 A1 (Barish) and US 2001/0042308 A1 (Barish) that such scraper edges can be relatively sharp and formed as either a square edge (15a, see FIG. 5) or an outwardly extending edge (25d, see FIG. 6), but in both cases this edge does not cut hairs. Nonetheless, it causes such significant skin irritation that during normal use of the electric shaver, it is not meant to contact the skin surface being shaved; rather, these documents teach that the electric shaver must first be tilted obliquely (compare shaving position LA where the hair-erecting edge is not engaged, with the tilted position LA' where the hair-erecting edge is engaged to erect hairs) to selectively engage the hair-erecting scraper where the user feels the electric cutter unit has missed a hair, which has the simultaneous disadvantage that the cutter unit is no longer at the intended orientation for efficient hair cutting. Indeed, other embodiments therein (FIGS. 7-8) teach that during a normal shaving action the scraper edges are completely out of contact with the skin. In other words, with these described devices, the user would be subject to skin irritation if he attempted to use the scraper edge constantly during normal operation of the electric hair cutter disc, and thus must forego the alleged benefit of a closer shave except in sporadic use where he determines that the electric hair cutter disc missed a spot, and he repeats the shave with the product tilted so as to engage the scraper edge into the skin and tolerate some irritation. This is also cumbersome and inefficient.

Another device is known from DE-A-34 28 631 A1 (Ebner) which discloses an electric shaver having a single foil-type reciprocating shaving unit together with an auxiliary blade element (4) disposed laterally of the main shaving unit in a recess of the shaving head and which, subsequent to completing the electric shaving operation, can be pivoted from a rest position (FIG. 5) into an outwardly extending operating position (FIG. 6) for removing stray long hairs which may have been missed during operation of the foil-type cutter unit. The documents explains at page 8, at the last paragraph of the disclosure, that the auxiliary cutting device (4) is deployed as an "emergency razor" when the battery has discharged There is however no suggestion that the foil-type cutter should be used in tandem with the blade unit and the geometry of the shaver would not make this feasible.

Combinations of hair manipulators and cutting members are also known, e.g. from WO-A-01/07212 and WO-A-01/07213 (Pragt).

Other types of shaving system are also known. For example, GB-A-1,444,960 (de Raemy) discloses a dry shaver having a cylindrically arcuate cutting surface defined by a plurality of cutting edges and means for rotationally reciprocating the cutter head about its longitudinal axis. In a preferred embodiment, the reciprocating cutter head is positioned beneath a cylindrically curved outer cutting foil. Further arrangements of this type are disclosed in GB-A-1,469,556 (Ascoli) and in GB-A-1,533,679 (Buchholz).

Another rotary appliance for removing hair is disclosed in WO-A-98/07551 (Garenfeld et al.), which comprises a rotary clamping device for clamping hair and subsequently extracting it at least partially from the skin, whereupon the hair is severed adjacent the skin by a separate shaver or hair trimmer arrangement (13, 29), consisting of a static shaver blade (33) adjacent the skin and a shearing blade (31) which reciprocate in shearing relationship. The appliance can be selectively set to a mode in which the oscillating shearing trimmer (13, 29) is decoupled from the drive, so that the appliance functions like a conventional epilator.

It has also been proposed in various published documents to provide in a shaving system a blade structure comprising a plate defining a plurality of apertures having annular sharpened shaving edges on the plate or formed in separate discs mounted to the plate. Systems of this type are disclosed in U.S. Pat. No. 5,604,983 (Simms et al.), U.S. Pat. No. 5,490,329 (Chylinski et al.), U.S. Pat. No. 3,702,026, U.S. Pat. No. 4,483,068, U.S. Pat. No. 4,807,360 and U.S. Pat. No. 5,153,992.

It has also been proposed to have a twin-blade assembly comprising two blade members secured for replacement, as a unit, in a plastics razor head of the wet shaving type, in order to have the ecological advantage of discarding the dulled blades and re-using the cartridge frame components, as disclosed in U.S. Pat. No. 5,551,153 (Simms).

As is well-known, the dry shaving system has advantages which are not shared by the wet shaving system, and vice versa. For example, the dry shaving system is exceptionally convenient for the user, does not require the application of liquid to the face and is comfortable. The wet shaving system, on the other hand, normally requires the application of a lubricant, such as soap, and for some users tends to produce more discomfort than the dry shaving system. It does however on the whole produce a closer shave, for most users, than a dry shaving system.

In spite of these known advantages and disadvantages, it has never previously been proposed to provide a hybrid shaving system combining the advantages of the dry shaving and the wet shaving systems without the attendant disadvantages.

SUMMARY

According to one aspect of the invention, there is provided a shaving apparatus comprising a drivable shaving unit having a skin-engaging cutter for performing a first shaving action on a user's skin; a motor adapted to drive the shaving unit to perform the first shaving action; and a razor blade having a guarded sharp cutting edge positioned for hair-cutting shaving engagement with the user's skin, whereby the blade performs a second shaving action during use of the shaving unit to perform the first shaving action, the drivable shaving unit being devoid of an exposed sharpened razor blade edge and comprising two cooperating cutter elements which cooperate to cut hair. The razor-sharp cutting edge is of the type commonly referred to as a "wet" shaving blade, whereas the drivable shaving unit is of the type referred to as a "dry" shaver, whether of the "short hair cutting unit" or "long hair cutting unit" construction.

It has been observed that non-humid conditions, such as prevailing in a dry winter climate, favor a conventional dry shaver, but that higher temperature and humidity leads to more hydration and more missed hairs. Thus, as hydration increases, that favors using instead a conventional "wet" shaving sharp blade. However, the arrangement of the present invention permits, even under disadvantageous temperature/humidity conditions, the efficiency of the overall system to approximate that of a non-humid day.

It is particularly preferred for the blade to be floatably mounted (i.e., spring mounted or biased on a resilient support). Moreover, it may be preferable to provide a second drivable shaving unit coupled to the motor and having a skin engaging cutter for performing a third shaving action on the user's skin, the blade being mounted between the first and second shaving units. In this construction, the first of the shaving units may be constructed as a short hair cutting unit and the second shaving unit may be constructed as a long hair cutting unit. In such a construction, the blade is expediently mounted on the long hair cutting unit. Alternatively, both the first and second shaving units may be of the same type, for example both short hair cutting units.

In a particularly preferred embodiment, a third drivable shaving unit may be coupled to the motor and constructed as a short hair cutter to perform a fourth shaving action, the second shaving unit being disposed between the first and third shaving units. In this construction, a second guarded razor-sharp blade may also be positioned for shaving engagement with the user's skin, so that the second blade can perform a fifth shaving action during use of the drivable shaving units to perform their own shaving actions. The blades may preferably be mounted on respective opposite sides of the long hair cutter unit.

The, or each, blade may be guarded by a portion of the adjacent shaving unit, e.g. the side region of a foil-type cutter. However, for improved safety and comfort, the or each blade may be mounted on a respective guard member. The guard member may be constructed as a bar of plastic or metal generally parallel to the extent of the sharp blade, as is known from the "wet" shaving art. Alternatively, the guard member may be provided by a plurality of fingers extending forwardly of the blade edge. For additional security, a guard wire may be provided along the distal ends of the fingers.

In one variant, the or each shaving unit may comprise an inner cutter mounted for hair shearing engagement with the skin engaging outer cutter thereof and coupled to the motor to be driven thereby. The or each inner cutter may be mounted for linear reciprocation. In this case, the or each razor-sharp blade preferably has a straight edge mounted parallel to the direction of linear reciprocation.

According to another aspect of the invention, there is provided shaving apparatus comprising a drivable shaving unit having an outer cutter for contact with the user's skin and an inner cutter mounted in hair shearing engagement with the outer cutter to provide a first shaving action; a motor adapted to drive the inner cutter to perform the first shaving action; and a razor-sharp blade having a cutting edge positioned for hair-cutting shaving engagement with the user's skin, whereby the blade performs a second shaving action during use of the drivable shaving unit to perform the first shaving action. The blade is preferably floatably mounted.

In one embodiment, a second drivable shaving unit is coupled to the motor and has an outer cutter for contact with a user's skin and an inner cutter mounted in hair shearing engagement with the outer cutter to provide a third shaving action, the blade being mounted between the first and second shaving units. In this embodiment, the first of the shaving units is preferably constructed as a short hair cutting unit and the second shaving unit is preferably constructed as a long hair cutting unit; alternatively, the first and second shaving units could be constructed to be the same. The blade may be mounted on the long hair cutting unit.

In another embodiment, there is further provided a third drivable shaving unit coupled to the motor and constructed as a short hair cutter to perform a fourth shaving action, the second shaving unit being disposed between the first and third shaving units.

In this further embodiment, a second guarded razor-sharp blade may be positioned for engagement with the user's skin whereby the second blade can perform a fifth shaving action during use of the drivable shaving units to perform their respective shaving actions.

In a further modification, the blades are mounted on respective opposite sides of the long hair cutter unit. In the illustrated embodiments, the first and second razor-sharp blades face in opposite directions so that naturally the second and fifth shaving actions will not occur simultaneously.

For improved comfort and safety, the or each blade may be mounted on a guard member providing a plurality of fingers extending forwardly of the blade edge. For extra security, a guard wire may be mounted along the distal ends of the fingers.

Preferably the or each inner cutter is mounted for linear reciprocation.

According to a further embodiment of the invention, there is provided shaving apparatus comprising: a shaver unit having a drivable skin-engaging cutter for performing a first shaving action on a user's skin; a motor adapted to drive the cutter to perform the first shaving action; and a guarded razor blade having a sharpened cutting edge positioned for hair-cutting engagement with the user's skin, whereby the blade performs a second shaving action during use of the shaving unit to perform the first shaving action, and the drivable skin-engaging cutter being mounted about an axis to be driven for pivotal motion, and the guard surface being disposed between the drivable skin-engaging cutter and the razor blade sharpened edge.

The blade is preferably floatably mounted and may expediently be mounted on the cutting unit.

In one embodiment, a second shaving unit is coupled to the motor and has a drivable skin-engaging cutter for performing a third shaving action on the user's skin, the blade being mounted between the first and second shaving units. In a further variation, a third drivable shaving unit is coupled to the motor and disposed between the first and third shaving units to perform a fourth shaving action during use of the apparatus.

In a further variation, a second guarded razor-sharp blade is positioned to perform a fifth shaving action similar to the second shaving action during use of the shaving unit.

Preferably, the blades are mounted on respective opposite sides of the third shaving unit.

For improved comfort and safety, the or each blade may be mounted on a guard member providing a plurality of fingers extending forwardly of the blade edge. For further security, a guard wire may be mounted along the distal ends of the fingers.

According to another aspect of the invention, there is provided a method of shaving comprising the steps of engaging the skin with the cutter of a drivable shaving unit; driving the shaving unit to perform a first, hair-shearing shaving action; and performing a second, hair-cutting shaving action with a razor blade having a sharpened cutting edge during the hair-shearing first shaving action, where the drivable shaving unit is devoid of an outwardly protruding sharpened razor edge and is comprised of two cooperating cutting elements which cooperate to cut hair.

The drivable shaving unit may comprise an outer cutter for contact with the user's skin and an inner cutter mounted in hair shearing engagement with the outer cutter in which case the motor will drive the inner cutter to perform the first shaving action.

In another embodiment, the shaving unit will comprise a drivable skin-engaging cutter for performing the first shaving action on the user's skin, in which case the motor will drive the cutter to perform the first shaving action.

According to a further embodiment of the invention, there is provided a blade unit sub-assembly that carries the razor-sharp blade edge or edges and that is mountable into a frame of a powered shaving head. This provides a replacement part so that the razor-sharp edges can be exchanged if they become dulled. In some embodiments the sub-assembly has twin blade supports and twin sharp blade edges that face in opposite directions and can be mounted between dry-type shaving units, and in preferred embodiments is mounted for biased displacement. In another embodiment the sub-assembly carries a spring-biased blade, and is preferably attached to an external surface of the shaving head.

For a better understanding of the invention and to show how the same can be carried into effect, reference will now be made, by way of example, to the accompanying drawings.

BRIEF DESCRIPTION OF THE DRAWINGS

In the various Figures, corresponding components are provided with corresponding reference numerals.

DETAILED DESCRIPTION OF THE INVENTION

Figure 1:
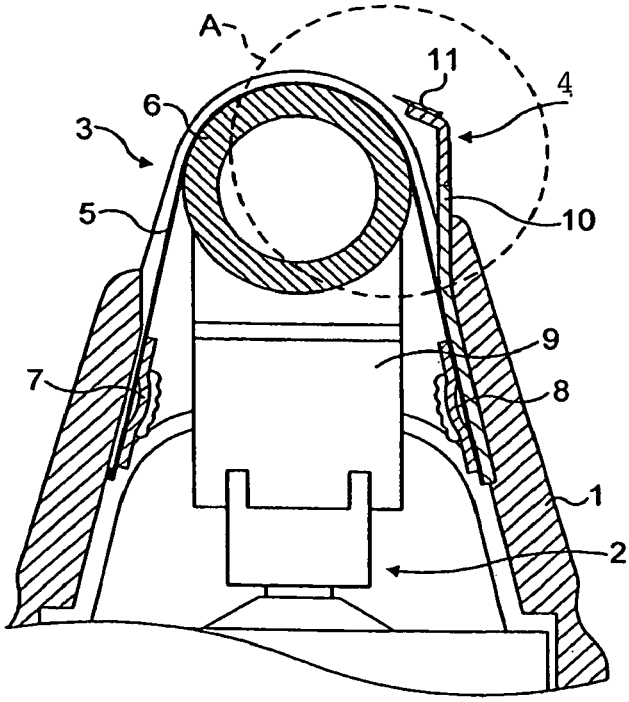
FIG. 1 shows a transverse sectional view through a shaving apparatus according to a first embodiment of the invention.
Figure 1A:
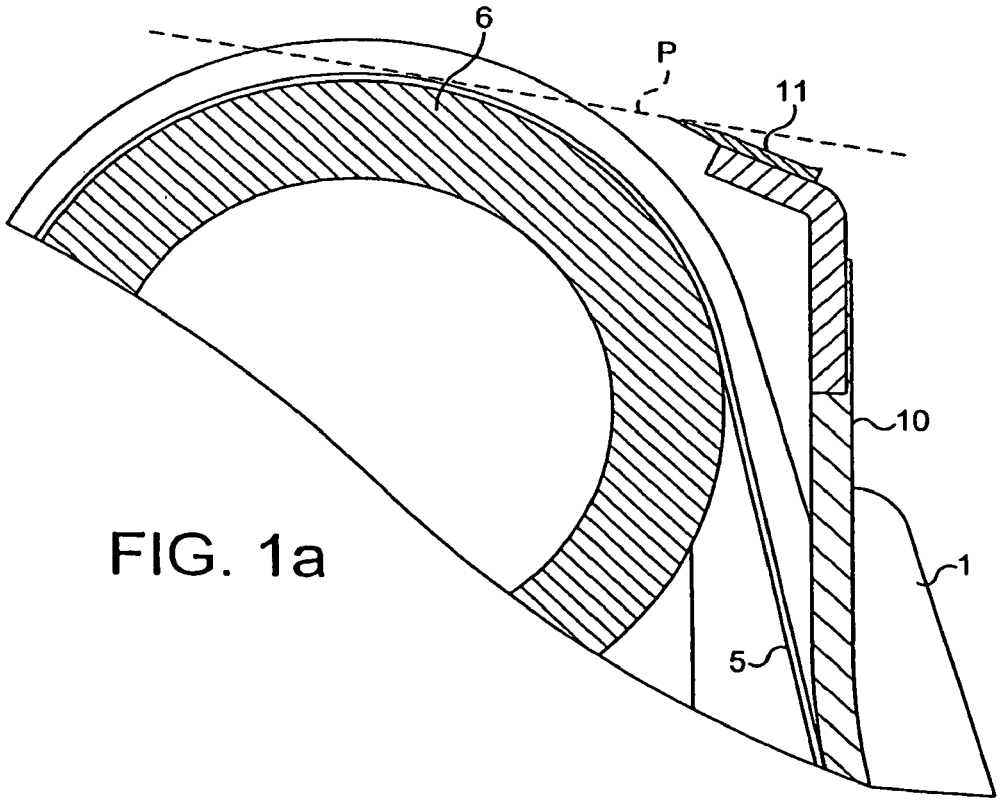
FIG. 1*a* shows region A of FIG. 1 at an enlarged scale.

FIG. 1 shows shaving apparatus having a housing 1 beneath which is mounted a motor and drive train shown generally at 2. As is known in the art, the housing 1 can be, for purposes of replacement, removable from the body housing within which the motor and transmission are mounted. The active components of the shaving apparatus are a foil-type reciprocating shaving unit 3 and a blade-type shaving unit 4. The foil-type reciprocating shaving unit 3 comprises a foil 5 and an undercutter 6. The foil 5 is attached to the housing 1, e.g. by rivets, at attachment points 7 and 8. The undercutter 6 is mounted on a block 9 which is coupled to the motor and drive train 2 and is biased into contact with the foil 5, in a substantially conventional manner by springs which are not shown. The blade unit 4 comprises a blade carrier 10 and a blade element 11 providing a razor-sharp edge positioned close to the foil 5. The razor-sharp edge is of the type commonly referred to as a "wet" razor blade which can cut or slice hair and can preferably cut or slice unsupported dry hair. The carrier 10 is secured to the housing 1 by being clamped between the foil 5 and the interior surface of the housing 1. Region A of FIG. 1 is shown at an enlarged scale in FIG. 1*a*.

During operation of the shaving apparatus, the user shaves in the conventional manner by drawing the dry shaving unit 3 across the skin surface. During this operation, hairs are also engaged by the razor-sharp edge of the blade 11 so that a dual or hybrid shaving action results, the first action being of the dry shave type and the second action of the wet shave type, being performed together. The blade unit 4 can perform either or both of two functions; firstly it performs a second cut on hairs already cut by the dry shaving unit 3 so that an even closer shave is produced; secondly it also acts to capture and cut any longer hairs which may be missed by the foil-type cutter. The user receives this benefit without having to wet or lather the beard or skin, or to make multiple passes, or to hold the appliance at different orientations, or to selectively engage different ones from among the "dry" and "wet" types of hair-removing units. However, a conditioning step may be included if desired; conditioning can include hydrating, lubricating or any other means of preparing the skin and/or hair to be shaved, and may or may not include the use of water. Lathering helps hydrate the hairs, and may also include agents such as soaps, gels, oils or emollients to reduce friction with the skin.

The dry shaving unit can be of the type disclosed in U.S. Pat. No. 6,098,289 (Wetzel), in particular having an outer apertured shaving foil and a reciprocating undercutter, which is hereby incorporated by reference. The shaving unit could also be constructed as is known from U.S. Pat. No. 5,745,995 (Yamashita et al.) having one or more rotary cutters of the type marketed under the name Hitachi, which is likewise incorporated by reference. As a consequence of the close proximity between the foil-type cutter unit 3 and the blade unit 4, the blade 11 is guarded, at least to some extent, by a portion of the surface of the foil 5 which thus assumes the function of what is commonly referred to—in the parlance of wet shaving—as the guard surface. An imaginary plane P can be constructed tangential to the blade 11 and guard surface of foil 5 which generally lies along the skin surface being shaved by the both units. The dimensions and geometry are chosen so that this arrangement is sufficiently safe.

However, in order to provide further safety and comfort, various techniques may be adopted.

Figure 2:
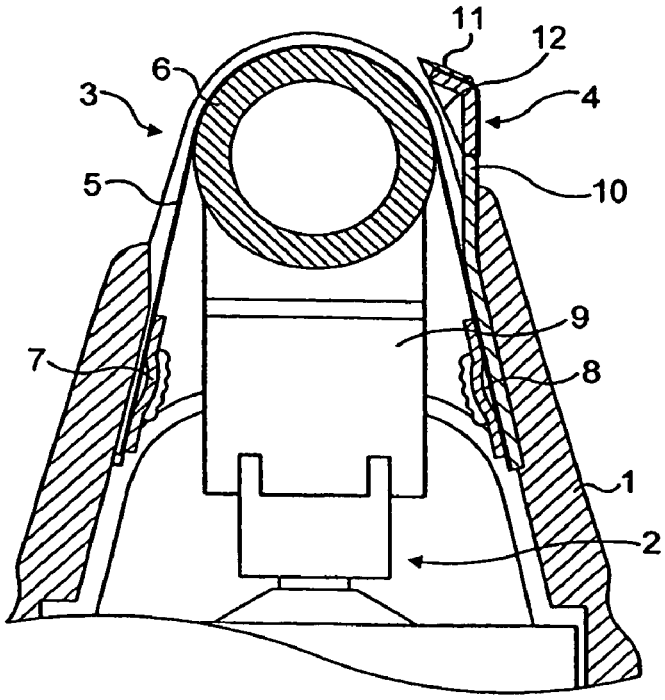
FIG. 2 shows a transverse sectional view through a shaving apparatus according to a second embodiment of the invention.

FIG. 2 shows an arrangement which is similar to FIG. 1 but with the further feature that the blade is provided with wire wrapping 12. This provides additional guarding for the razor-sharp edge and increases the level of safety for the user. Patent document U.S. Pat. No. 5,305,526 is representative of this feature and is hereby incorporated by reference.

Figure 3:
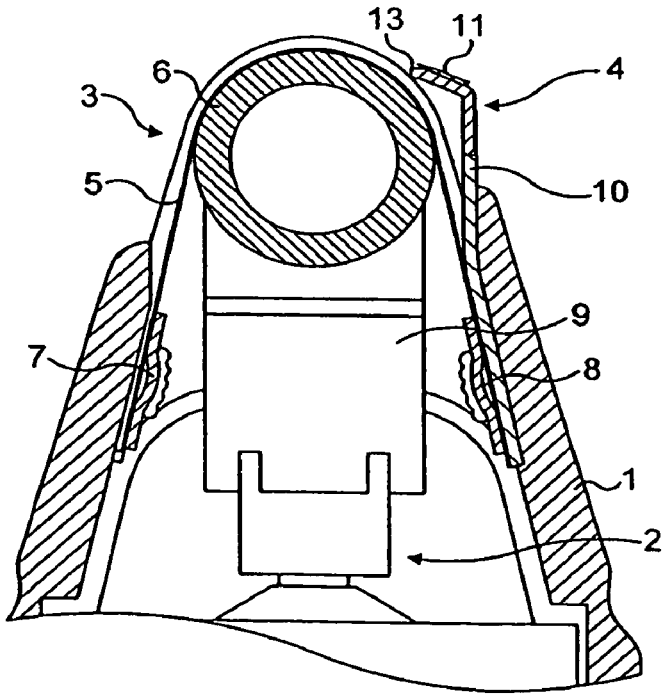
FIG. 3 shows a transverse sectional view through a shaving apparatus according to a third embodiment of the invention.

FIG. 3 shows an alternative method for improving safety and comfort. Here the blade support member 10 extends beyond the sharpened edge of the blade 111 in the form of a plurality of fingers 13 or "safety skis", Patent document WO 98/35795 is representative of this feature and is hereby incorporated by reference.

Figure 4:
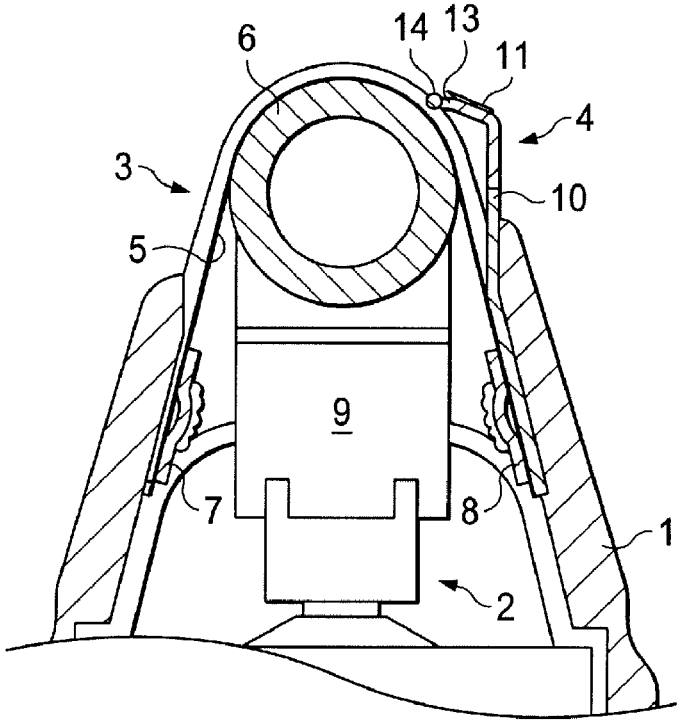
FIG. 4 shows a transverse sectional view through a shaving apparatus according to a fourth embodiment of the invention.
Figure 12:
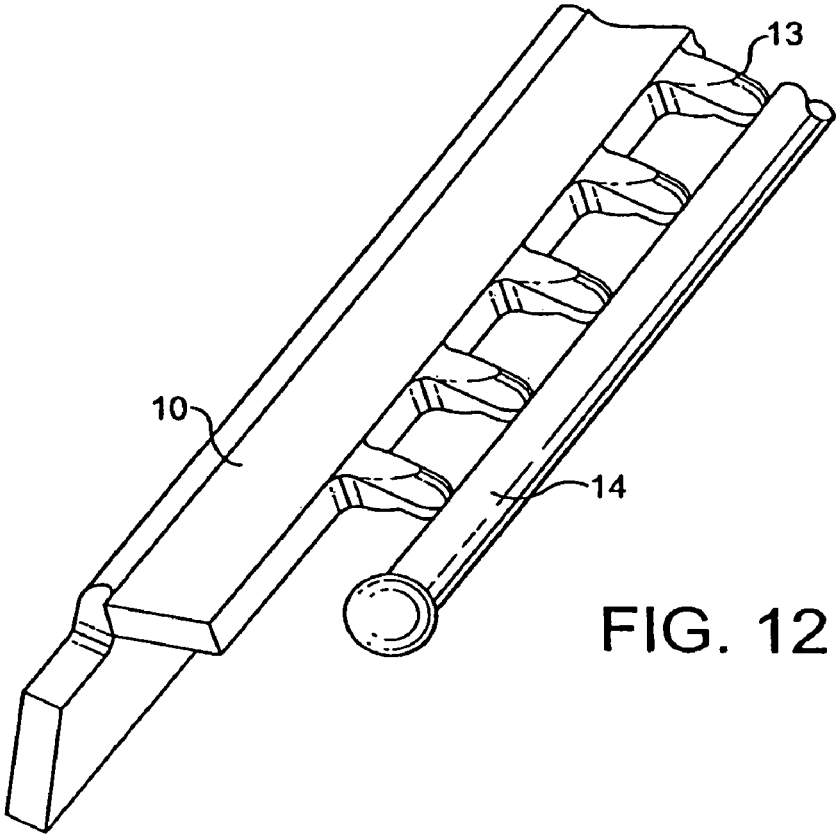
FIG. 12 shows more detail of the guard and blade support used in the embodiment of FIG. 4 with the blade removed.
Figure 13:
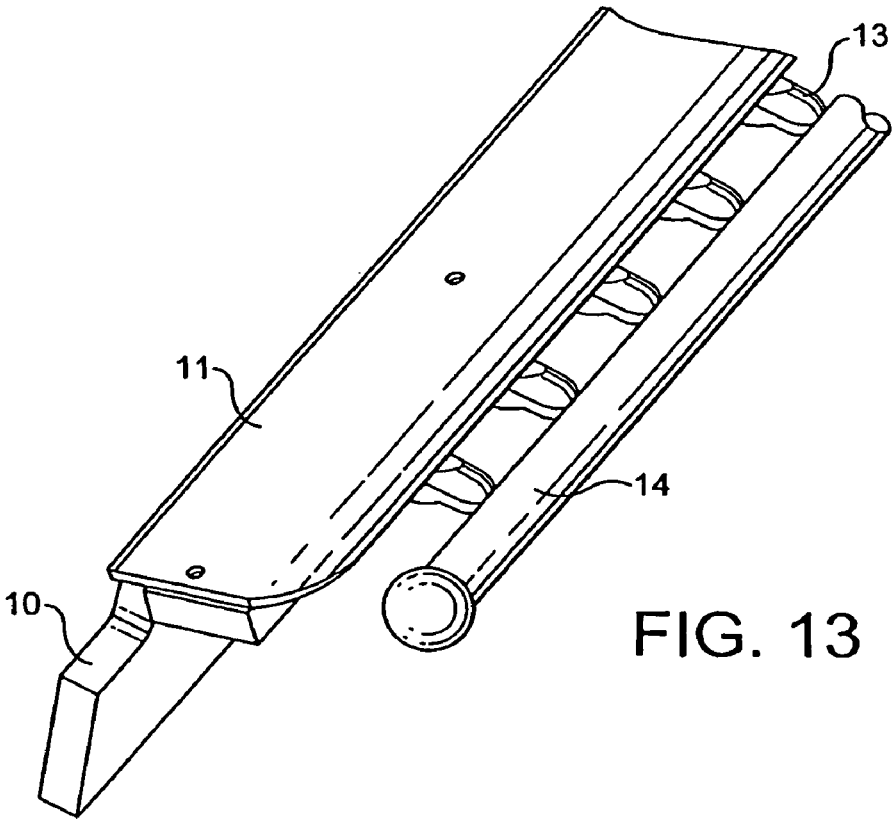
FIG. 13 shows the guard and blade support of FIG. 12 with the blade installed.

In the embodiment of FIG. 4, which is otherwise similar to that of FIG. 3, safety and comfort are further enhanced by the provision of a longitudinal wire 14 connected along the distal ends of the fingers 13 of the safety skis, as best shown in FIGS. 12 and 13.

Figure 5:
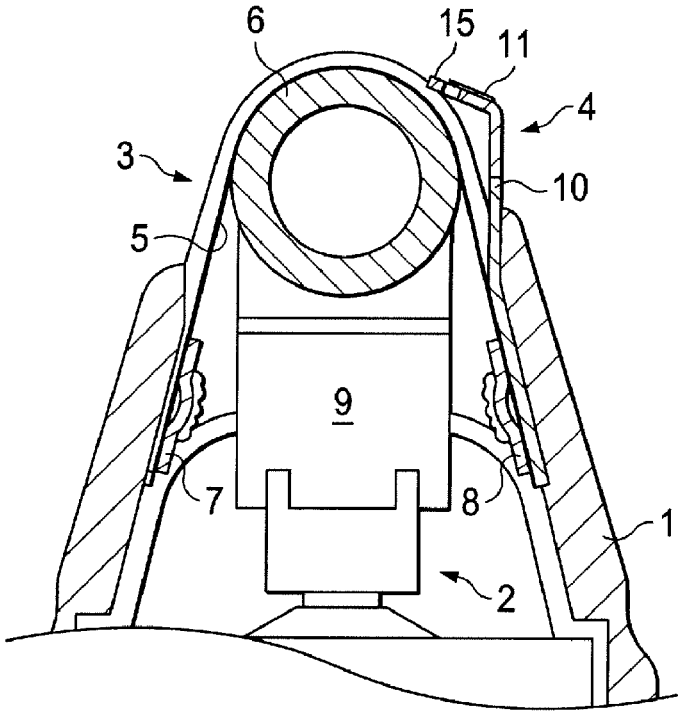
FIG. 5 shows a transverse sectional view through a shaving apparatus according to a fifth embodiment of the invention.
Figure 14:
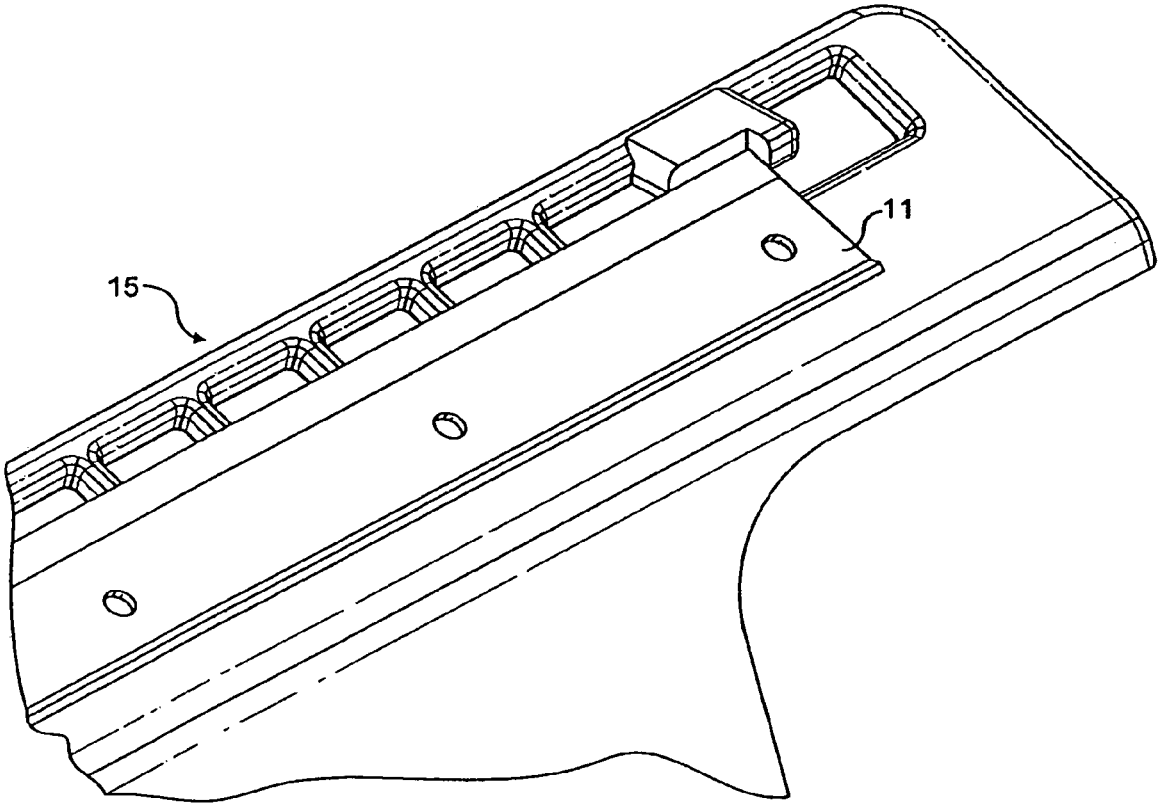
FIG. 14 shows more detail of the guard used in the embodiment of FIG. 5.

The embodiment of FIG. 5, which is otherwise similar to the embodiment of FIG. 1, provides an etched and polished guard 15 as better shown in FIG. 14. This acts as a skin protection device to prevent slicing.

Figure 6:
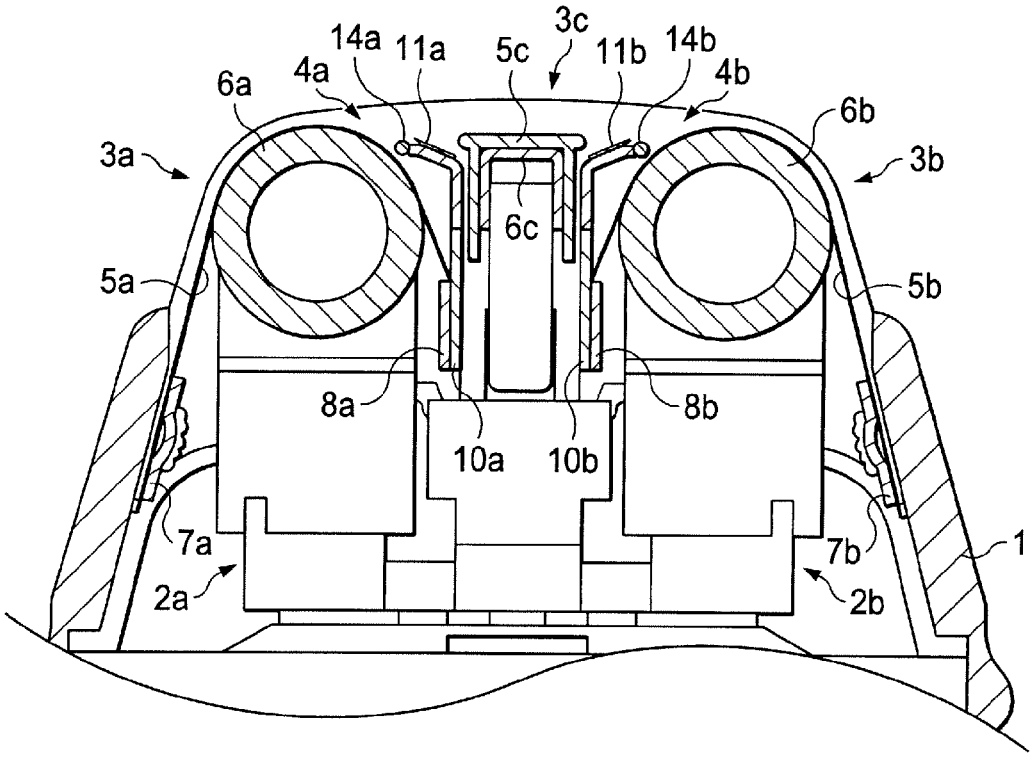
FIG. 6 shows a transverse sectional view through a shaving apparatus according to a sixth embodiment of the invention, in which two foil-type shaving units and a central trimmer unit are provided.

FIG. 6 shows how two razor-sharp blades may be incorporated into a triple head shaver comprising three reciprocating foil-type shaving units 3*a*, 3*b* and 3*c*. Units 3*a* and 3*b* are essentially the same as the shaving unit 3 shown in each of FIGS. 1 to 5 and are constructed for cutting short hairs. Shaving unit 3*c* is however constructed and adapted specifically for shaving longer hairs. It comprises an outer skin-engaging cutter 5*c* and a reciprocating undercutter 6*c*. All three shaving units 3*a*, 3*b* and 3*c* are coupled to a common drive motor in the housing. Short hair cutters and a long hair trimmer are disclosed in U.S. Pat. No. 6,098,289 (Wetzel) and U.S. Pat. No. 5,669,138 (Wetzel), each of which is hereby incorporated by reference.

In this embodiment, two separate blade units 4*a* and 4*b* are provided on opposite sides of the long hair cutting unit 3*c*. As illustrated, each blade unit is provided with safety skis and a guard wire and thus corresponds substantially to the construction shown in FIGS. 4,12 and 13.

Figure 7:
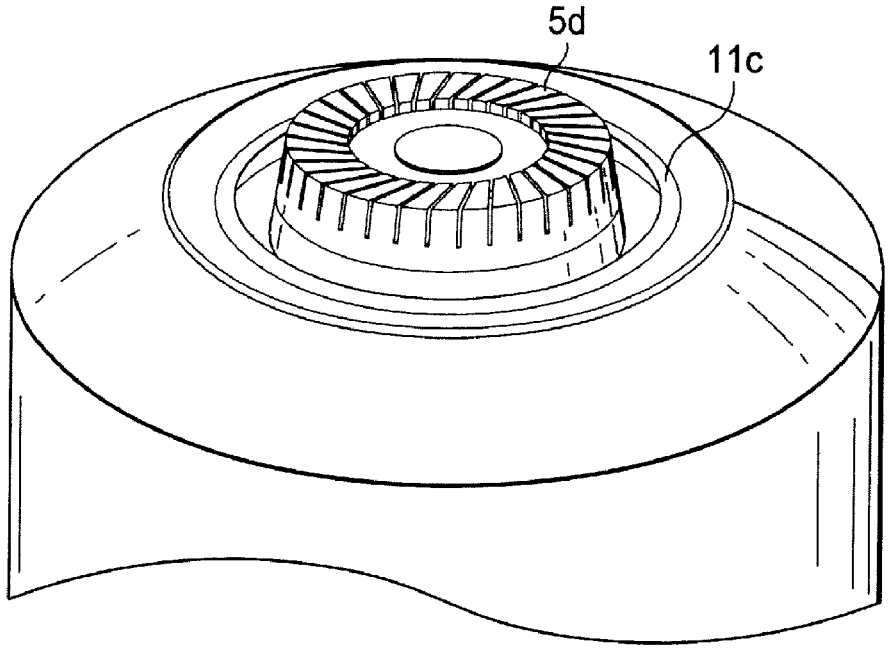
FIG. 7 shows a schematic isometric view of a rotary shaving apparatus according to a seventh embodiment of the invention.
Figure 8:
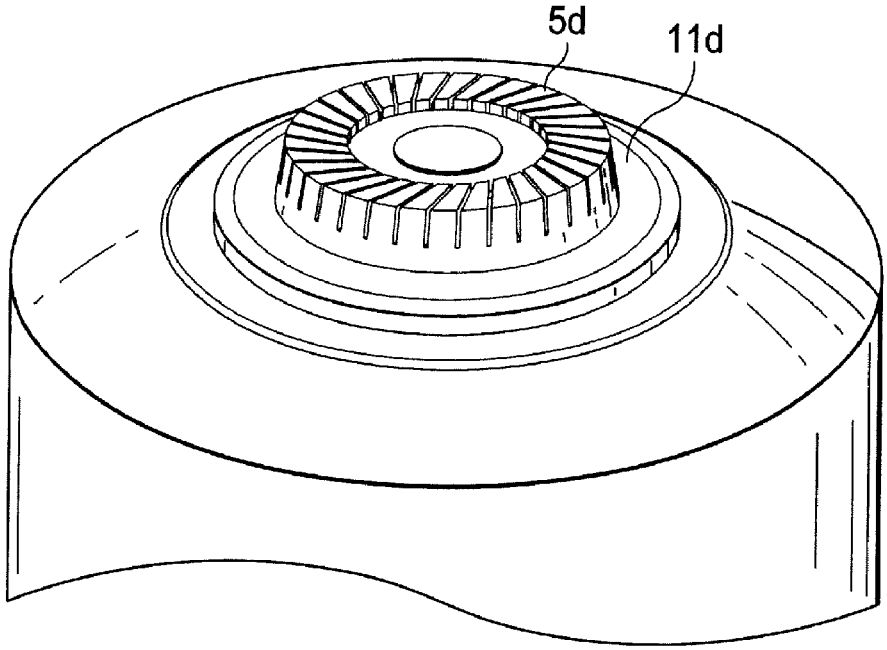
FIG. 8 shows a schematic isometric view of a rotary shaving apparatus according to an eighth embodiment of the invention.
Figure 9:
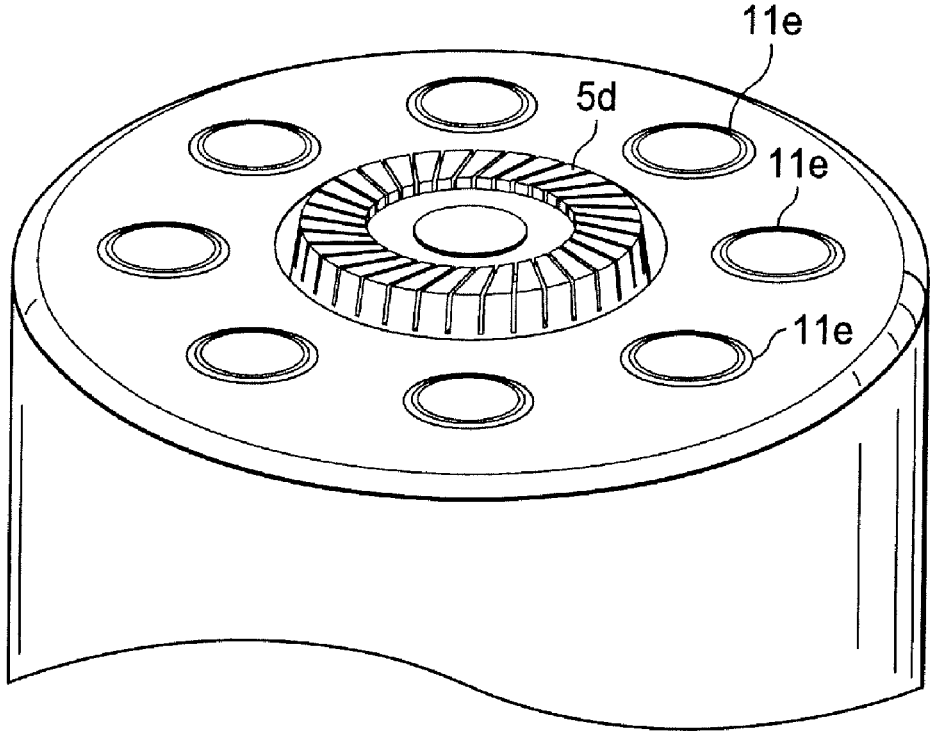
FIG. 9 shows a schematic isometric view of a rotary shaving apparatus according to a ninth embodiment of the invention.

FIGS. 7, 8 and 9 show how the concept of the invention may be applied to foil-type shavers of the rotary type.

FIG. 7 shows a single rotary shaving unit having a stationary outer cutter 5*d* beneath which a rotary undercutter (not shown) is driven in continuous rotation by a motor (not shown) within the housing. Surrounding the rotary shaving unit is provided an annular sharp-edged blade 11*c* facing inwardly towards the shaving unit.

FIG. 8 shows a rotary shaving system corresponding to that shown in FIG. 7 but here the annular sharp-edged blade 11*d* faces outwardly from the rotary shaving unit.

In the embodiment of FIG. 9, a single rotary shaving unit is provided, corresponding to that shown in FIGS. 7 and 8. However, it is here surrounded by multiple sharp-edged inwardly facing annular blades 11*e*. Patent document U.S. Pat. No. 5,490,329 (Chylinski et al.) discloses similar annular blades, and is hereby incorporated by reference.

Figure 10:
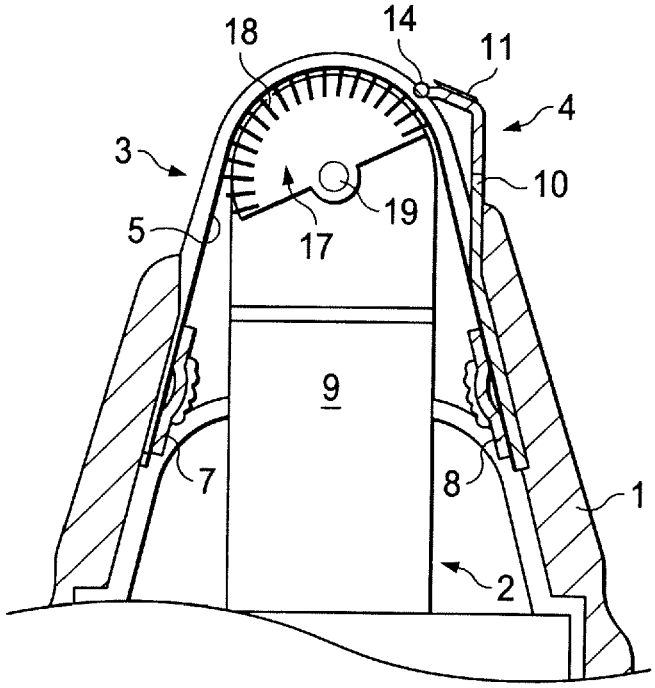
FIG. 10 shows a transverse sectional view of a shaving apparatus according to a tenth embodiment of the invention.
Figure 11:
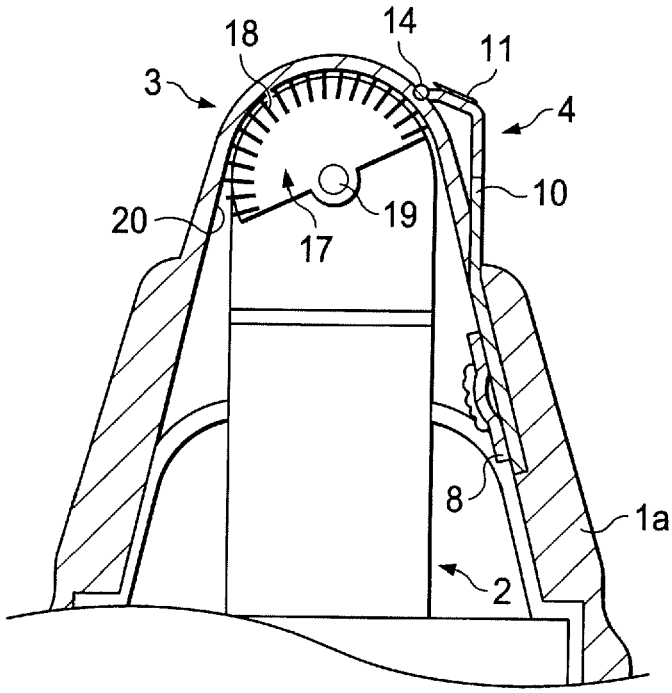
FIG. 11 shows a modification of the apparatus of FIG. 10 according to a further embodiment of the invention.

FIG. 10 shows how the concept of the invention may be applied to a shaving system of a type having a rotary cylindrical cutter or rockable cylindrical cutter of the type disclosed, for example, in GB-A-1,533,679, GB-A-1,469,556 and GB-A-1,444,960, which are all incorporated by reference. The shaving system comprises an outer foil 5 and an undercutter 17 comprising a plurality of longitudinally extending vanes or blades 18, which may be resiliently biased into contact with the foil 5 by respective springs (not shown). The cutter is mounted for rocking motion about an axis 19. In this device, the blade unit 4 is constructed essentially identically to that shown in FIG. 4 and FIG. 6. In some constructions, the foil may be omitted if the cylindrical cutter is guarded appropriately as shown, for example, in FIG. 11. In FIG. 11, a part of the housing 1*a* is extended in an arcuate manner to form a guard 20. In this construction, it would be undesirable to bias the blades 18 into contact with the guard 20, although the blades may still be mounted on resilient supports to permit retreat under load.

Figure 15:
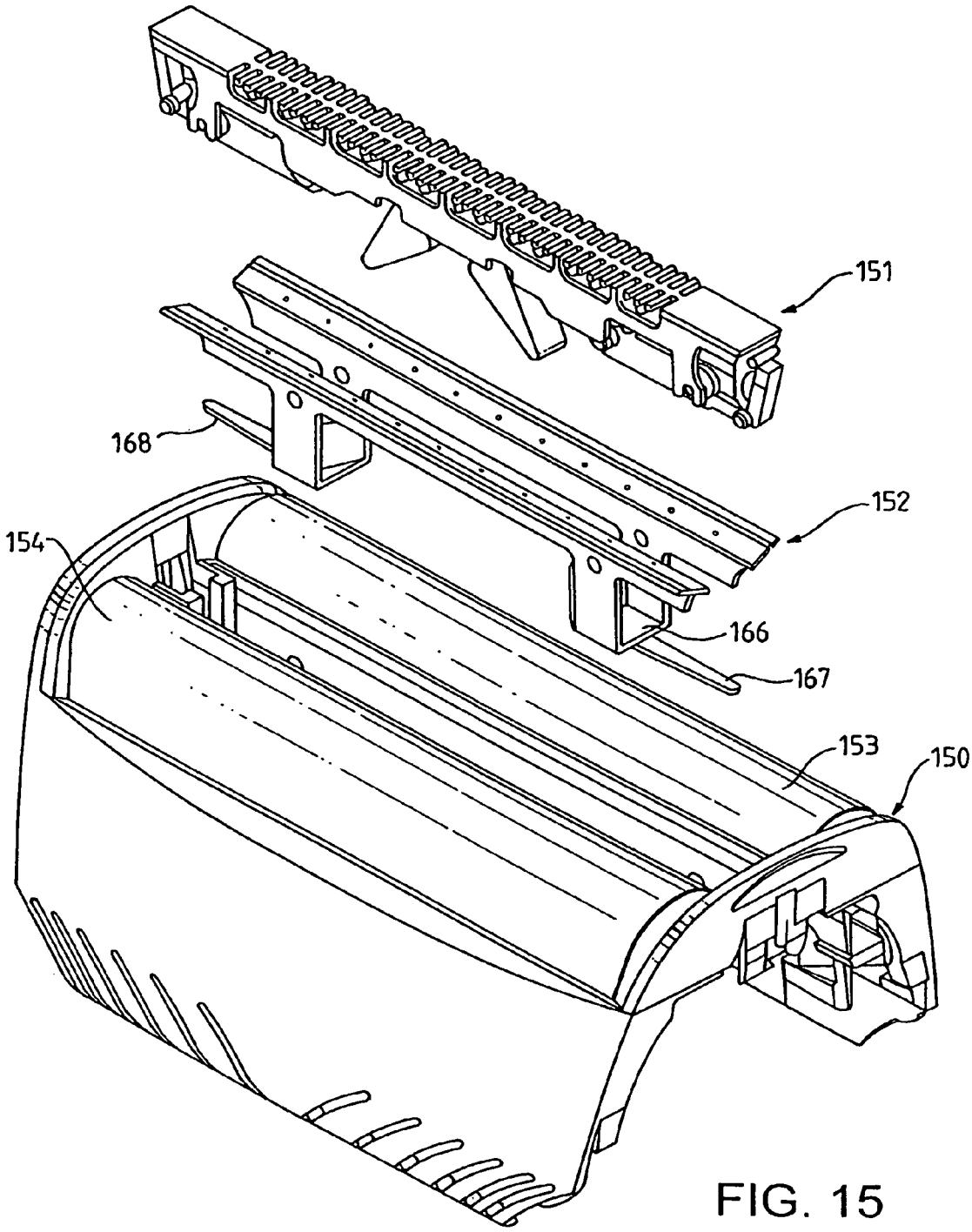
FIG. 15 shows an exploded view of a foil frame assembly including a central long hair cutting unit and blade cassette unit according to a further embodiment of the invention.
Figure 16:
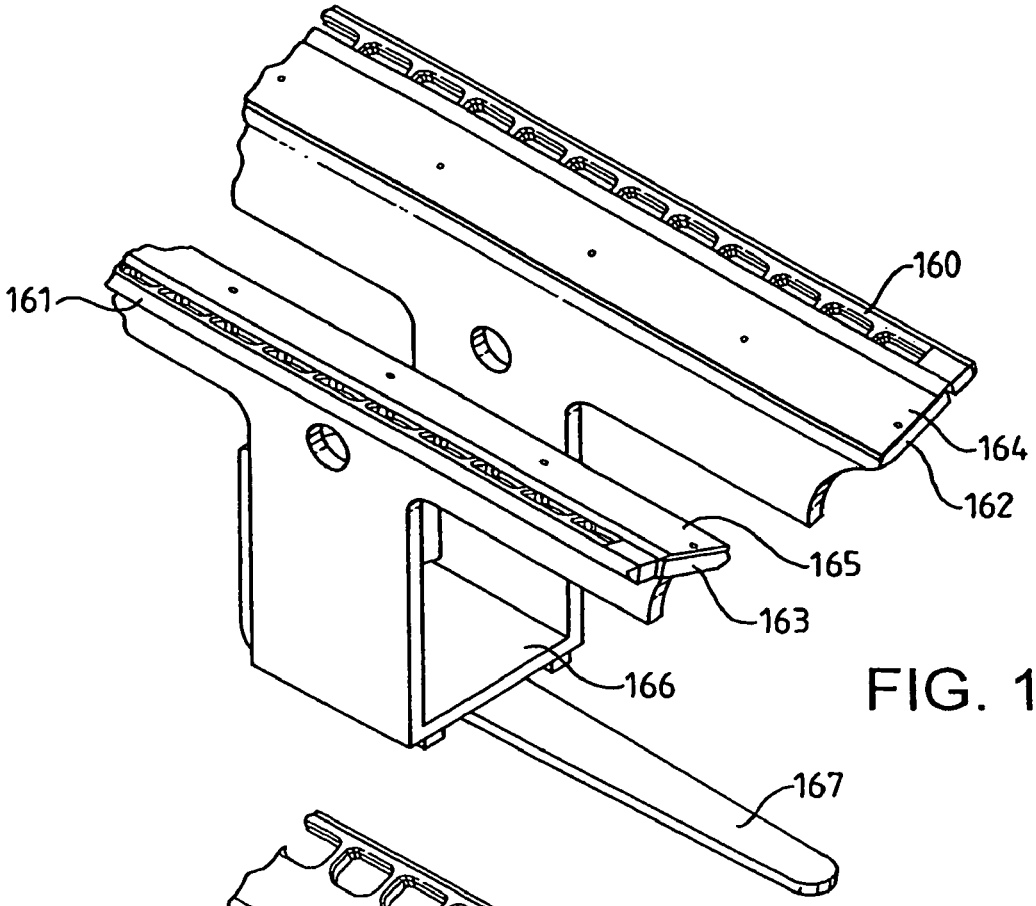
FIG. 16 shows an enlarged detail of the blade cassette unit of FIG. 15, showing etched and polished guards with installed blades.
Figure 17:
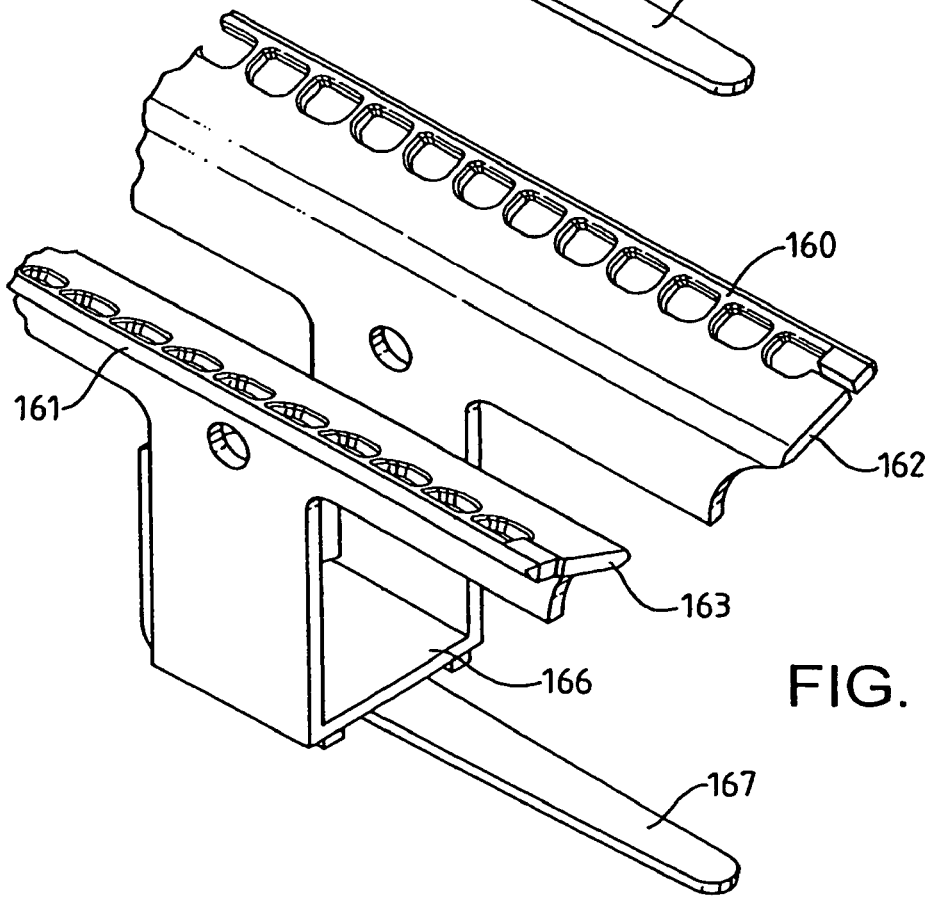
FIG. 17 shows an enlarged detail of the blade cassette unit of FIG. 15 showing the etched and polished guards with the blades removed.

FIG. 15 shows a further embodiment of the invention in which a pair of razor-sharp blades are installed into a triple head dry shaving unit of the same general type as illustrated in FIG. 6. FIG. 15 shows only the foil frame assembly consisting of three components; a foil frame 150, a centre long hair cutting unit 151 and a blade cassette unit 152. The frame 150 and centre long hair cutter unit 151 are substantially conventional in construction. The foil frame 150 carries a pair of foils 153,154 which constitute respective outer cutters of a pair of short hair cutting units. The long hair cutter unit 151 and blade cassette unit 152 are fitted into the slot-like aperture existing between the foils 153 and 154. Further detail of the blade cassette unit 152 may be taken from FIGS. 16 and 17. FIG. 16 shows an enlarged detail of the blade cassette unit having etched and polished guards 160 and 161 of the type illustrated in FIG. 14. The guards 160 and 161 are formed integrally with a pair of blade support members 162 and 163 respectively. Each of the blade support members 162 and 163 carries a respective razor-sharp blade 164 and 165. The sharpened edges of the blades 164 and 165 are directed outwardly in the direction of the respective short hair cutter units illustrated in FIG. 15. FIG. 17 shows the same blade cassette unit with the blades removed to avoid obscuring the detail of the etched and polished guards 160 and 161. The blade support members 162 and 163 can be connected together through a pair of webs 166 to form a subassembly, which facilitates the convenient assembly and replaceability of the razor-sharp blades as a unit when they become dulled through use. From each web 166, an elongate tang 167, 168 extends. The tangs 167, 168 constitute springs which snap fit into slots on the foil frame to permit vertical displacement against a resilient bias.

Figure 18:
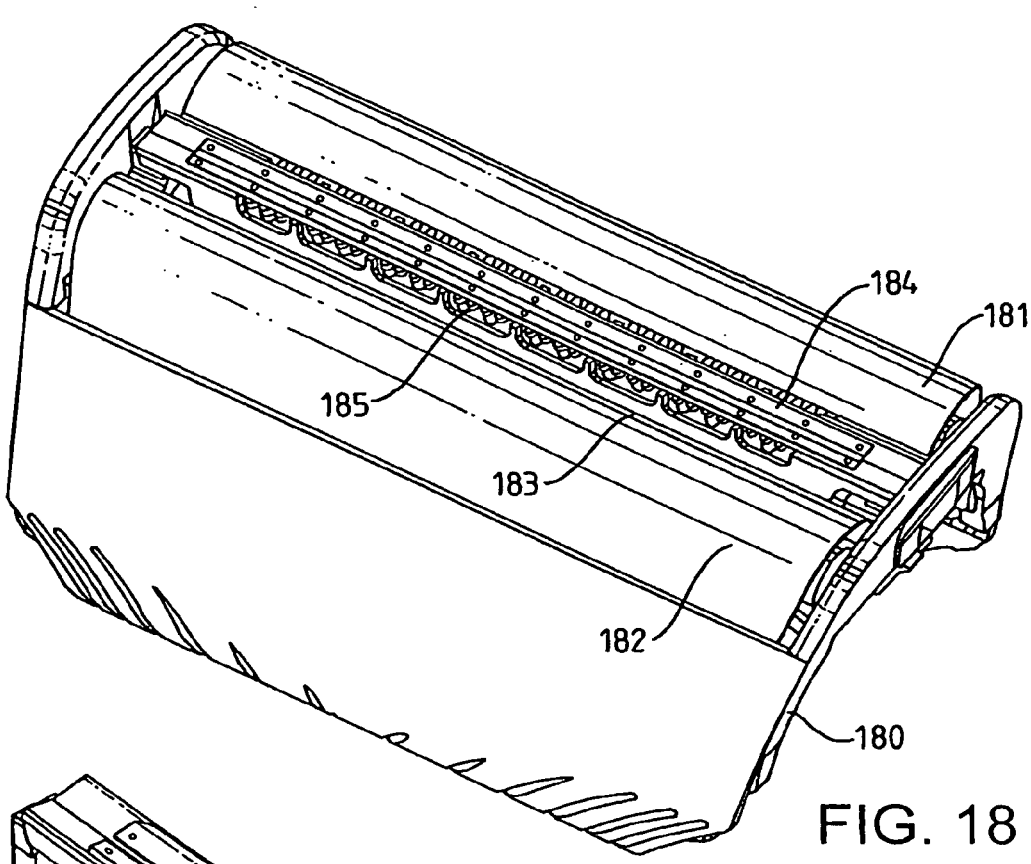
FIG. 18 shows a foil frame with a central long hair cutting unit carrying centrally mounted blades according to a further embodiment of the invention.
Figure 19:
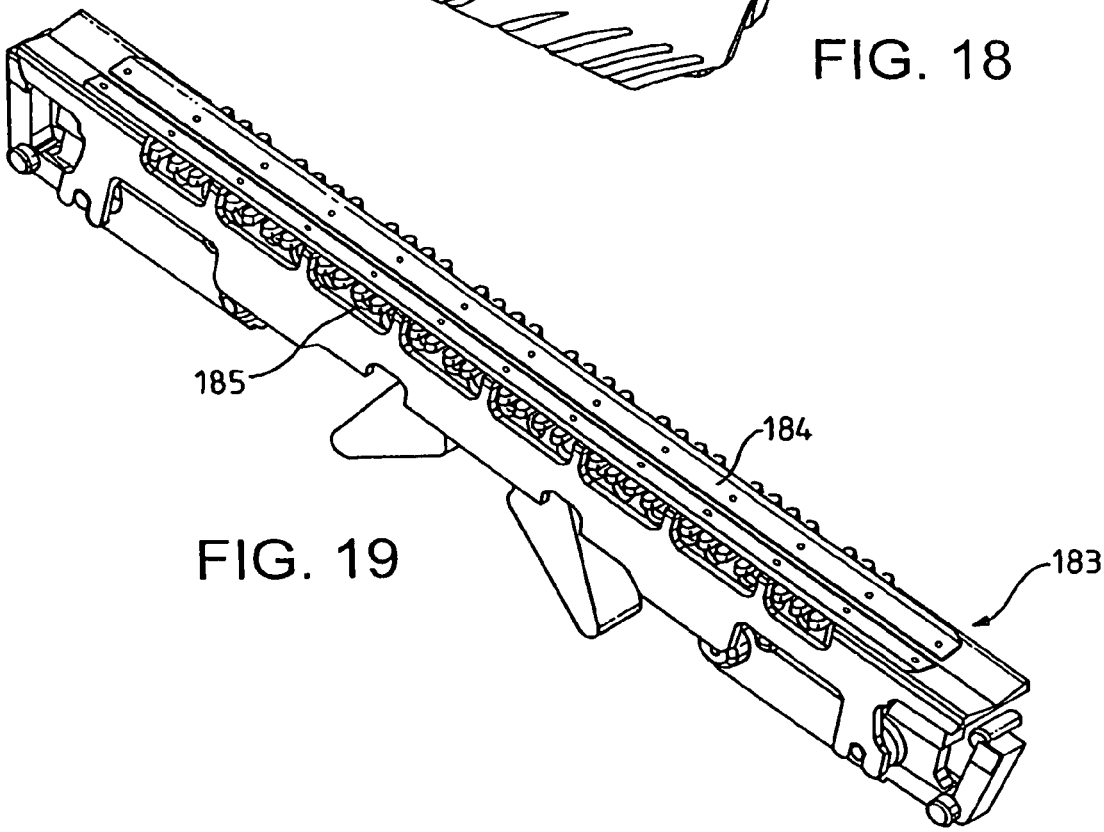
FIG. 19 shows a central long hair cutter unit with outwardly facing blades set into a top angled recess for use in the embodiment of FIG. 18.
Figure 20:
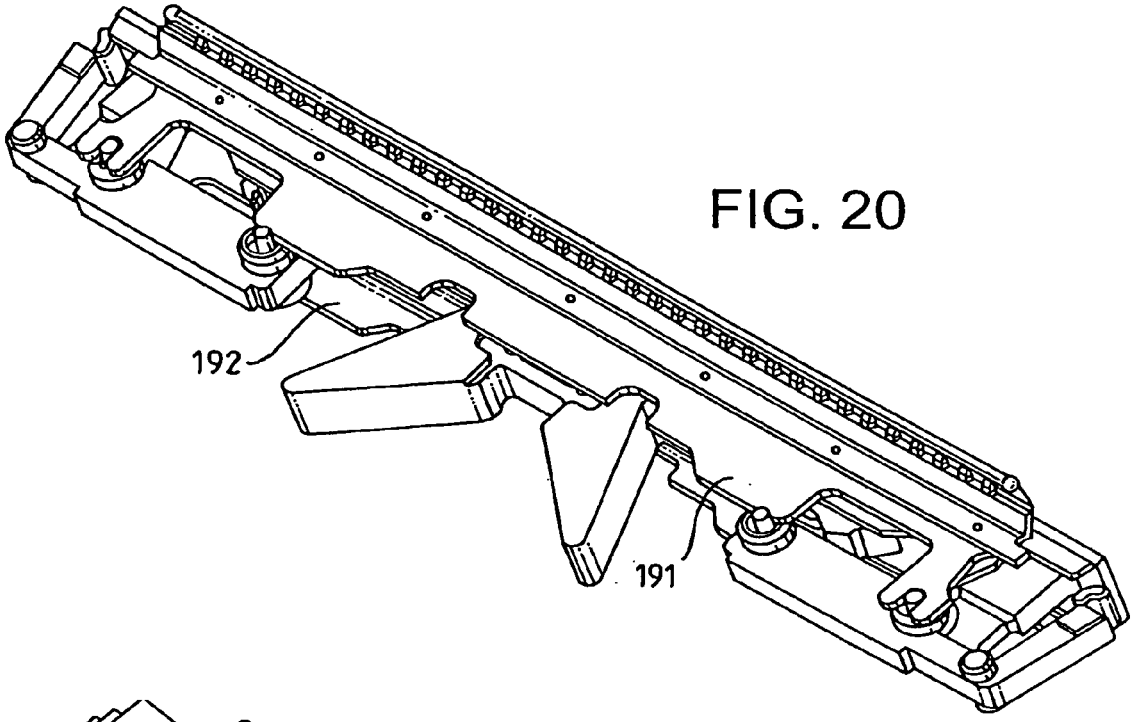
FIG. 20 shows a lower three-quarter view of a central long hair cutter unit having guarded safety skis and blades secured to respective side walls of the outer cutter for use in a modification of the embodiment of FIG. 18.
Figure 21:
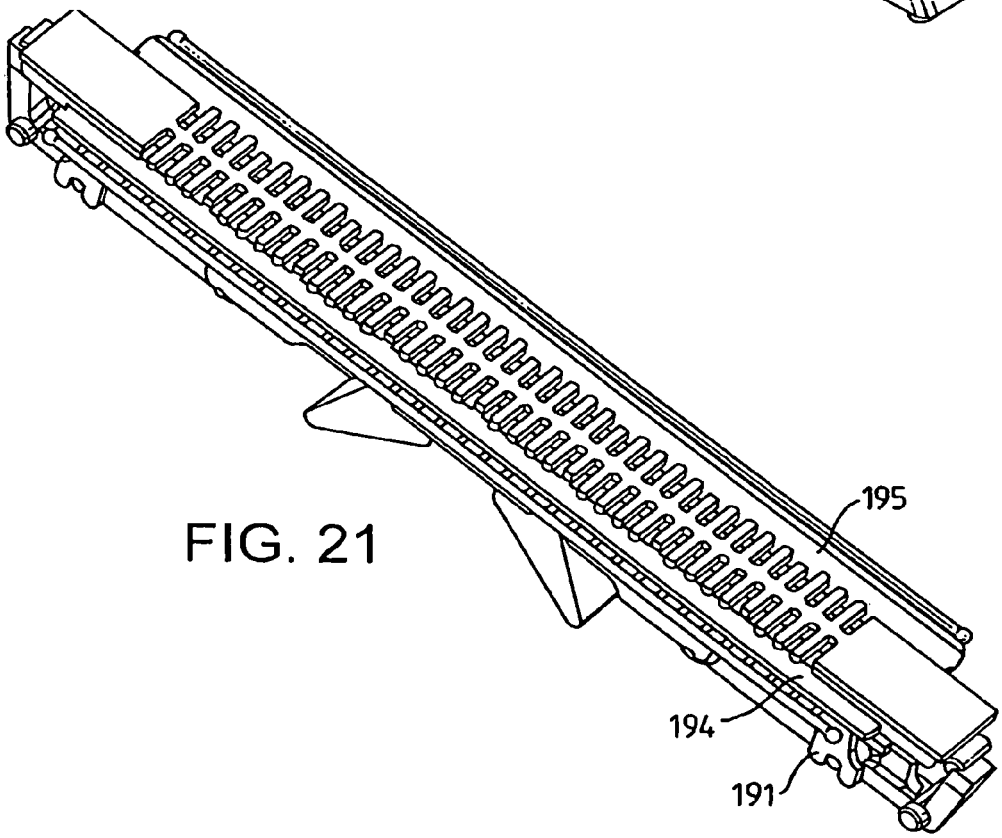
FIG. 21 shows an upper three-quarter view of the central long hair cutter unit of FIG. 20.

FIG. 18 shows a foil frame 180 carrying a pair of foils 181 and 182 to constitute the outer cutters of a pair of short hair cutter units. Between the foils 181 and 182 is located a long hair cutter unit 183 which carries on its outer cutter a pair of outwardly directed razor-sharp blades 184 and 185. The central long hair cutter unit, together with its razor-sharp blades 184 and 185, are better shown in FIG. 19. FIG. 19 shows clearly how the blades 184 and 185 are mounted into a top angled recess on the upper surface of the central long hair cutter unit 183. Alternatively, as shown in FIGS. 20 and 21, blades 194,195 could be mounted onto supports 191,192 that form side walls of the long hair trimmer unit, in a position analogous to that shown in FIG. 15. As illustrated, the blades 194,195 are guarded using the safety ski system 13 and longitudinal wire 14 described in connection with FIGS. 12 and 13.

In either of the embodiments shown in FIG. 15 or FIGS. 18-21, the long hair trimmer unit can be mounted to the shaving head frame by a laterally extending arm on each narrow end (seen at the ends of unit 151) that is received, such as with a snap-fit, in respective slots in the head frame either with clearance such that the long hair trimmer unit can displace vertically under spring bias, as in commercial models of electric "dry" shavers sold by the company Braun under the trade designation "Flex Integral", or generally without much clearance so there is little, if any, vertical displacement, as in commercial models of electric "dry" shavers sold by the company Braun under the trade designation "Synchro". In cases where there is relative movement of the long hair trimmer to the shaving head frame, the spring bias can be provided by the shaver's drive pin, which is received in the inverted "V"-shaped coupling block attached to the moving undercutter 6*c*, being mounted to a spring (not shown), as is generally known from U.S. Pat. No. 6,098,289 (Wetzel) as shown in FIGS. 3-3A thereof.

Figure 22:
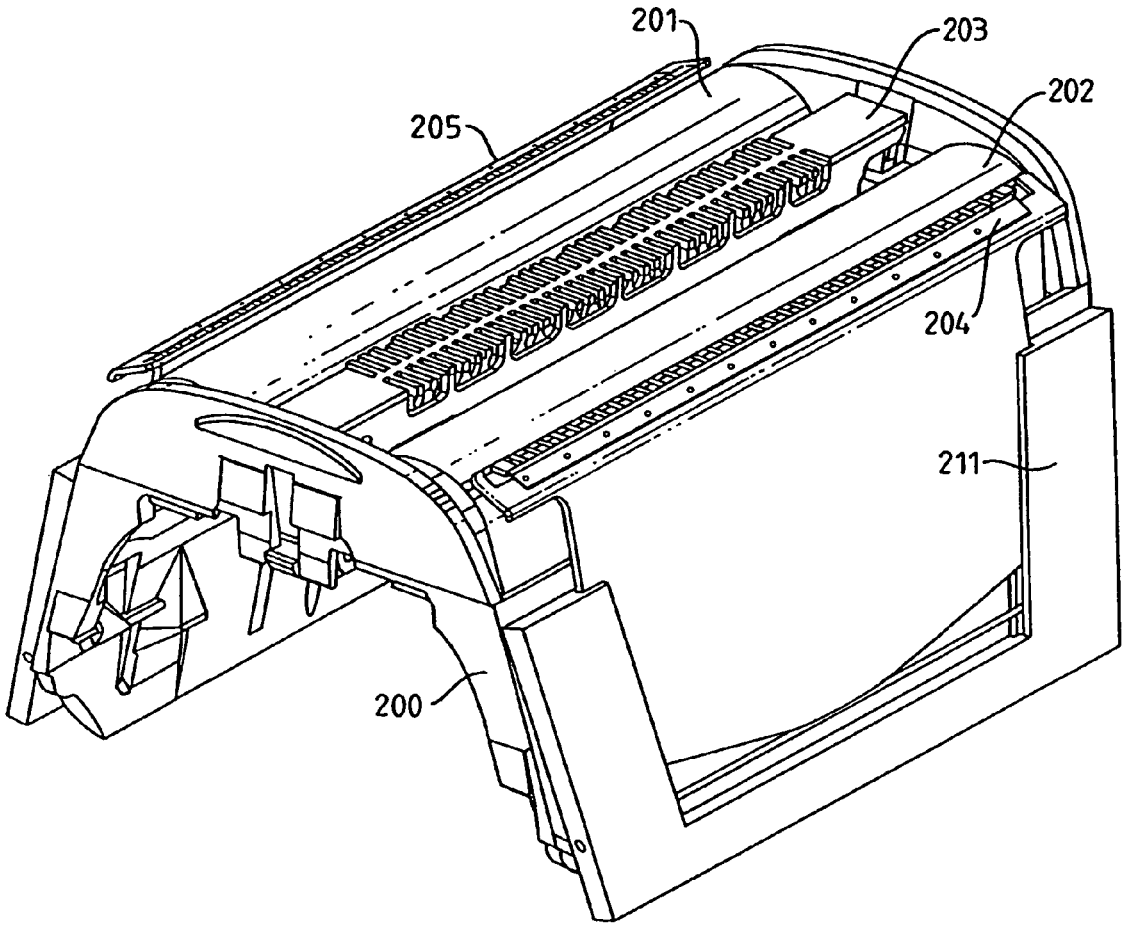
FIG. 22 shows a foil frame carrying a pair of short hair cutter units and a central long hair cutter unit, together with two external independently suspended blades located in guides attached to outer sides of the foil frame according to a further embodiment of the invention.
Figure 23:
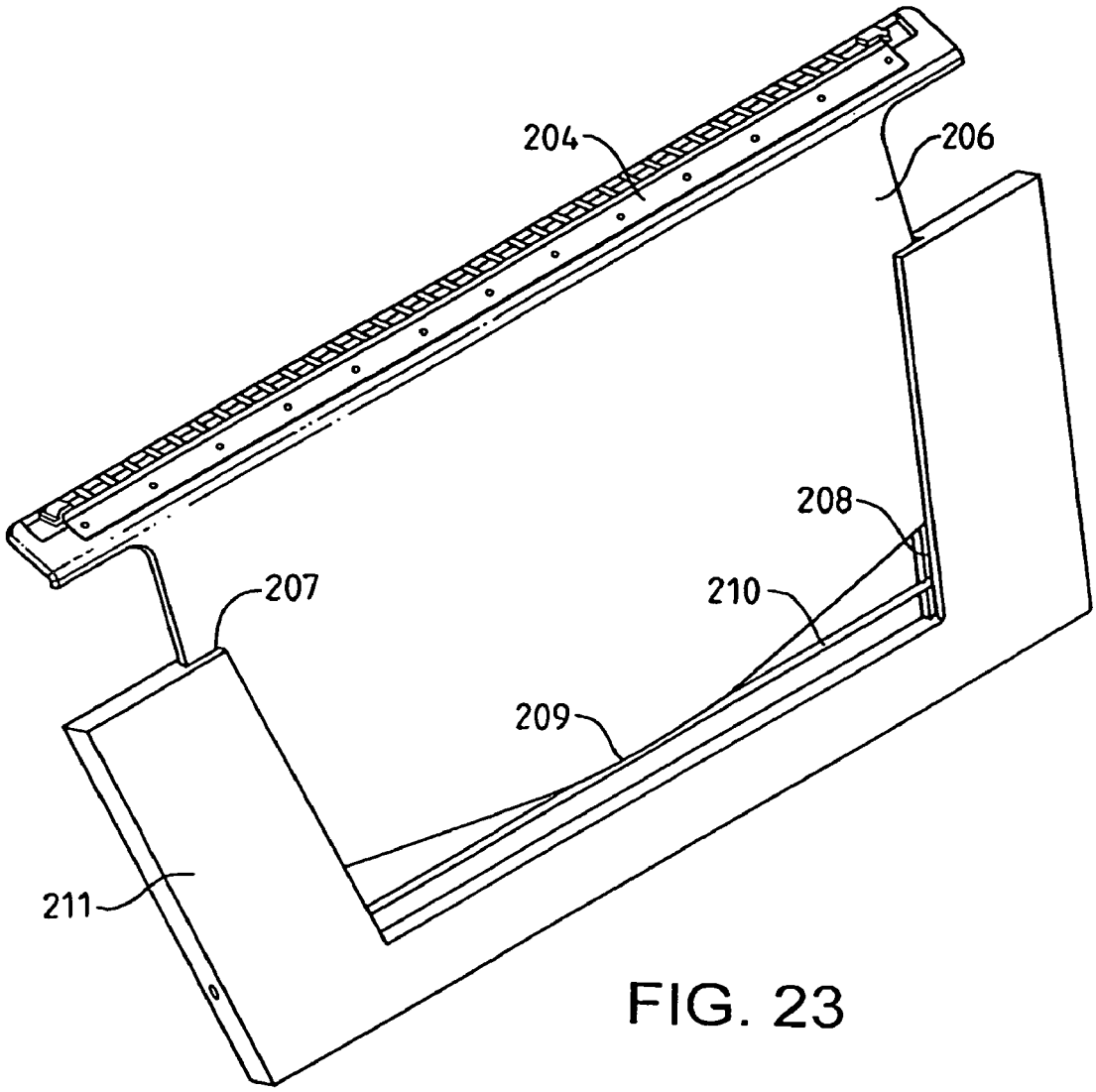
FIG. 23 shows an independently suspended external blade mounted on a single transverse spring located in a supporting guide system for use in the embodiment of FIG. 22.

FIG. 22 shows a foil frame with a pair of foils and a central long hair cutter unit according to a further embodiment of the invention. In FIG. 22, the foil frame 200 carries first and second foils 201 and 202 between which is mounted a substantially conventional long hair cutter unit 203. On each external side of the foil frame 200 is mounted a respective independently suspended razor-sharp blade 204 and 205. The blade 204, together with its mounting arrangement, is better shown in FIG. 23. As illustrated, the blade 204 is mounted on an etched and polished blade support and guard arrangement 15 of the type shown in FIG. 14. The blade support is secured to or formed integrally with a plate 206 which is slotted into a U-shaped frame 211 providing a pair of elongate guides 207 and 208. At its lower edge 209, the plate 206 is mounted on a single transverse leaf or wire spring 210 held by the frame 211. The blade and its support are thus resiliently mounted to enable the blade and its support to retreat in response to forces applied by contact with a user's skin. This helps to maintain a relatively constant contact force between the blade and the user's skin. The blade and mounting arrangement may be integral with, e.g. moulded integrally with, or attached to frame 200 e.g. by attachment structure (not shown) such as a slot and pin arrangement, snap-fit pins or rivets, preferably such that the blade and mounting arrangement are removable and interchangeable when the blade's razor-sharp cutting edge becomes dulled.

In any of the above described embodiments, a lubricant or other conditioner dispenser or lubricant strip may be provided to reduce friction between the razor-sharp blade or blades and the user's skin, and consequently improve shaving comfort. A suitable strip can be mounted rearward of the sharp blade and includes polyethylene oxide ("polyox").

As for the blade or blades, in the embodiments shown in FIGS. 1 to 6 and 10 to 23 an essentially standard razor blade may be employed such as those marketed by Gillette under the trade designations Sensor and Sensor Excel or as disclosed in U.S. Pat. No. 5,661,907 (Apprille, Jr.), which is incorporated by reference, or those used in the Gillette product marketed under the trade designation Mach3.

The sharpness of such blades is conventionally defined by the tip radius in a manner known to those skilled in the art. Measured in a conventional way, the tip radius, may typically be less than 0.5 microns, which would be a relatively blunt blade, and may lie in the range 0.5 microns to 50 nm (nanometers)(i.e., 0.05 microns), which would be relatively sharp. In the embodiments of the present invention, the blade sharpness may lie anywhere between these extremes, depending on the cutting effect desired, as is well-known to those skilled in the art. It can even be advantageous to have a tip radius smaller than 0.05 microns, in some circumstances.

It has been observed that conventional Sensor, Sensor Excel or Mach3 blades give a short lifetime before becoming dulled when used dry in the embodiments disclosed herein. Thus it is preferred to use a blade that has a similar geometry to such blades but is thicker in the tip region than such standard "wet" blades, for example having the geometry shown in TABLE 1 below.

A particularly preferred blade is a Cr/Pt coated stainless steel blade with the tip profile defined by TABLE 1 below:

TABLE 1

| Distance from the tip (microns) | Width of the blade (microns) |
|---|---|
| 1 | 0.68 |
| 2 | 1.25 |
| 4 | 2.27 |
| 8 | 4.22 |
| 16 | 7.78 |
| 20 | 9.52 |

In any of the above-described embodiments, the sub-assembly comprising the frame or housing which supports both the razor-sharp blade or blades (and where applicable its or their blade mounting supports) together with at least an outer cutter of one of the dry-type shaving units (such as an outer foil, as shown in FIG. 1), or an entire dry-type shaving unit (such as a long hair trimmer, as shown in FIG. 15) can collectively define a replaceable part that is exchangeable when the sharp blades have become dulled.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving apparatus comprising:

a drivable shaving unit for performing a first shaving action on a user's skin, the drivable shaving unit comprising both a skin-engaging outer cutter and an undercutter that cooperates by relative movement with the outer cutter to cut hair, the relative movement being parallel to an axis;

a motor that drives the relative movement of said shaving unit to perform said first shaving action;

a wet shaving razor blade having a sharp cutting edge, the sharp cutting edge, which is arranged parallel to said axis and stationary with respect to movement along said axis, is positioned for shaving engagement with the user's skin whereby a second shaving action is performed when said sharp cutting edge is moved in a direction transverse to said sharp cutting edge and across the user's skin; and a guard surface provided substantially between said sharp cutting edge and said shaving unit, whereby said razor blade is capable of performing said second shaving action to cut hair during use of said shaving unit for performing said first shaving action.

2. The shaving apparatus according to claim 1 wherein said wet shaving razor blade is mounted to be retreatable in a direction transverse to said axis and against a spring bias.

3. The shaving apparatus according to claim 1 wherein said guard surface is integral with said wet shaving razor blade.

4. The shaving apparatus according to claim 1, wherein said guard surface is defined by a guard member disposed proximate and extending along said sharp cutting edge.

* * * * *